US009686610B2

(12) United States Patent
Kursula et al.

(10) Patent No.: US 9,686,610 B2
(45) Date of Patent: Jun. 20, 2017

(54) DIGITAL MEMS LOUDSPEAKER

(71) Applicant: Intel Corporation, Santa Clara, CA (US)

(72) Inventors: Mikko Kursula, Lempaala (FI); Kalle I. Makinen, Nokia (FI); Saku Lahti, Tampere (FI)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 14/843,469

(22) Filed: Sep. 2, 2015

(65) Prior Publication Data

US 2017/0064450 A1 Mar. 2, 2017

(51) Int. Cl.

| | |
|---|---|
| ***H04R 3/00*** | (2006.01) |
| ***H04R 3/12*** | (2006.01) |
| ***H04R 1/20*** | (2006.01) |

(52) U.S. Cl.

CPC ..... *H04R 3/12* (2013.01); *H04R 1/20* (2013.01)

(58) Field of Classification Search

CPC . A61M 2205/3375; H04R 1/005; H04R 1/42; H04R 3/12; H04R 1/20

See application file for complete search history.

(56) References Cited

U.S. PATENT DOCUMENTS

| | | | | |
|---|---|---|---|---|
| 2006/0062420 | A1 | 3/2006 | Araki | |
| 2010/0008521 | A1* | 1/2010 | Cohen | H04R 1/005 381/98 |
| 2010/0322454 | A1* | 12/2010 | Ambrose | H04R 1/1016 381/380 |
| 2011/0110550 | A1 | 5/2011 | Bharatan et al. | |
| 2014/0084396 | A1 | 3/2014 | Jenkins et al. | |
| 2014/0182965 | A1* | 7/2014 | Chatterjee | G10K 9/02 181/157 |
| 2015/0092971 | A1* | 4/2015 | Kim | H04R 25/558 381/328 |

FOREIGN PATENT DOCUMENTS

| | | |
|---|---|---|
| JP | 2006060418 | 3/2006 |

OTHER PUBLICATIONS

International Search Report and Written Opinion for International Patent Application No. PCT/US2016/044739, mailed on Oct. 12, 2016.

* cited by examiner

*Primary Examiner* — Muhammad N Edun

(74) *Attorney, Agent, or Firm* — Green, Howard & Mughal LLP.

(57) ABSTRACT

Devices related to digital MEMS loudspeakers are discussed. Such devices may include an air pressure source, MEMS valves coupled to the air pressure source, and an audio modulator coupled to the MEMS valve to receive an audio signal and to control the MEMS valves via a modulation signal to provide an acoustic output.

23 Claims, 8 Drawing Sheets

DIGITAL MEMS LOUDSPEAKER

BACKGROUND

In acoustic transducer systems, loudspeakers and earpieces may be implemented using dynamic transducers that employ fixed magnets and moving voice coils such that an analog electrical audio signal is converted to sound. Such devices may be relatively large in physical size and may use costly rare earth metal materials. Furthermore, such systems may utilize digital-to-analog conversion (DAC) techniques and/or analog power amplifiers and may be relatively inefficient, converting only about 1% of electrical power to acoustic power.

Such current loudspeaker and earpiece devices may therefore be relatively large, costly, and inefficient. It may be desirable to provide smaller, more efficient, and less costly loudspeaker and earpiece devices. It is with respect to these and other considerations that the present improvements have been needed. Such improvements may become critical as the desire to provide high quality sound becomes more widespread.

BRIEF DESCRIPTION OF THE DRAWINGS

The material described herein is illustrated by way of example and not by way of limitation in the accompanying figures. For simplicity and clarity of illustration, elements illustrated in the figures are not necessarily drawn to scale. For example, the dimensions of some elements may be exaggerated relative to other elements for clarity. Further, where considered appropriate, reference labels have been repeated among the figures to indicate corresponding or analogous elements. In the figures.

DETAILED DESCRIPTION

Figure 1:
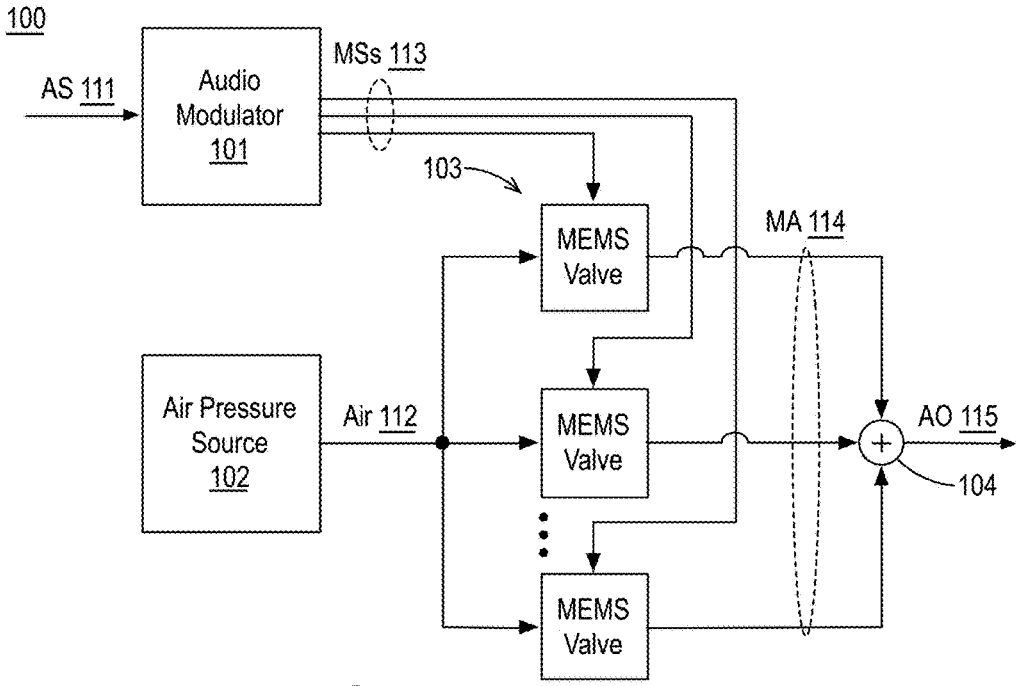
FIG. 1 illustrates an example digital loudspeaker.

One or more embodiments or implementations are now described with reference to the enclosed figures. While specific configurations and arrangements are discussed, it should be understood that this is done for illustrative purposes only. Persons skilled in the relevant art will recognize that other configurations and arrangements may be employed without departing from the spirit and scope of the description. It will be apparent to those skilled in the relevant art that techniques and/or arrangements described herein may also be employed in a variety of other systems and applications other than what is described herein.

While the following description sets forth various implementations that may be manifested in architectures such as system-on-a-chip (SoC) architectures for example, implementation of the techniques and/or arrangements described herein are not restricted to particular architectures and/or computing systems and may be implemented by any architecture and/or computing system for similar purposes. For instance, various architectures employing, for example, multiple integrated circuit (IC) chips and/or packages, and/or various computing devices and/or consumer electronic (CE) devices such as audio devices, multi-function devices, tablets, smart phones, etc., may implement the techniques and/or arrangements described herein. Further, while the following description may set forth numerous specific details such as logic implementations, types and interrelationships of system components, logic partitioning/integration choices, etc., claimed subject matter may be practiced without such specific details. In other instances, some material such as, for example, control structures and full software instruction sequences, may not be shown in detail in order not to obscure the material disclosed herein.

The material disclosed herein may be implemented in any suitable system and portions may be implemented in hardware, firmware, software, or any combination thereof. The material disclosed herein may also be implemented as instructions stored on a machine-readable medium, which may be read and executed by one or more processors. A machine-readable medium may include any medium and/or mechanism for storing or transmitting information in a form readable by a machine (e.g., a computing device). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others.

References in the specification to "one implementation", "an implementation", "an example implementation", (or "embodiments", "examples", or the like), etc., indicate that the implementation described may include a particular feature, structure, or characteristic, but every embodiment may not necessarily include the particular feature, structure, or characteristic. Moreover, such phrases are not necessarily referring to the same implementation. Further, when a particular feature, structure, or characteristic is described in connection with an embodiment, it is submitted that it is within the knowledge of one skilled in the art to effect such feature, structure, or characteristic in connection with other implementations whether or not explicitly described herein.

Devices, systems, apparatuses, methods, and articles are described herein related to digital micro-electro-mechanical systems (MEMS) loudspeakers.

As described above, in acoustic transducer systems, current loudspeaker and earpiece devices may be relatively large, costly, and inefficient. It may be desirable to provide loudspeakers and associated systems, methods, and articles that provide more efficient, inexpensive, and, optionally, smaller loudspeakers. In some embodiments discussed herein, a digital loudspeaker may include an air pressure source, one or more valves coupled to (e.g., in fluid communication with) the air pressure source, and an audio modulator coupled to the valve such that the audio modulator may receive an audio signal and control the valves via a modulation signal to provide an acoustic output from the digital loudspeaker. As used herein, the term in fluid communication with may indicate components that may allow fluids such as air, gases, or liquids to move therebetween. For example, components that have an acoustic or pneumatic connection may be described as in fluid communication. In some embodiments, the one or more valves may be MEMS valves as discussed herein. In other embodiments, the one or more valves may be non-MEMS valves. Furthermore, the loudspeakers, devices, systems apparatuses, methods, and articles discussed herein are illustrated and described with respect to MEMS valves for the sake of clarity of presentation. However, as discussed, such valves may be MEMS or non-MEMS valves.

As is discussed further herein, the air pressure source may include a MEMS pump or a full-size pump and/or pressure chamber in fluid communication with inlets of the valves and the valves may include any suitable valves such as MEMS valves having the same or different characteristics with respect to one another. The audio modulator may be implemented via hardware, firmware, software, or a combination thereof and may directly digitally (e.g., without digital-to-analog conversion) provide the modulation signal. The modulation signal may provide a timed ON/OFF signal to the valves such that the valves provide an acoustic output to a user or users. The modulation signal may be modulated using pulse width modulation, pulse density modulation, pulse amplitude modulation, pulse frequency modulation, a combination thereof, or the like.

In some embodiments, the digital loudspeaker may further include a second air pressure source such that the air pressure source is a positive air pressure source and the second air pressure source is a negative air pressure source. As used herein, the term negative air pressure source indicates an air pressure source at a pressure level lower than atmospheric pressure and the term positive air pressure source indicates an air pressure source at a pressure above atmospheric pressure. Such embodiments may include two air pumps (e.g., one for each air pressure source) or the air pressure sources may share a single air pump (e.g., such that the air pump provides positive pressure to the positive air pressure source and negative pressure to the negative air pressure source). Such dual air pressure source embodiments may provide the advantage of eliminating modulation challenges caused by the pressure offset when only a single positive air pressure source is used, as is discussed further herein.

The digital loudspeakers discussed herein may be implemented via any suitable system having any suitable form factor. For example, the valves and the audio modulator may be implemented via a single die to form a monolithic device. Such a monolithic device may be housed in a speaker component and implemented via the speaker of wired or wireless ear buds, a laptop, a tablet, a smart phone, a mobile audio device, a wearable device or the like. In such embodiments, MEMS valves may be particularly advantageous due to their small size. In other embodiments, such speaker components may be implemented in larger housings and may be implemented via home audio systems, public address systems, sound reinforcement systems, or the like. In yet other embodiments, the digital loudspeakers discussed herein may be implemented to generate ultrasonic acoustic signals for ultrasonic gesture sensing applications or the like.

The acoustic transducers and related devices and techniques discussed herein may provide direct digital acoustic sound synthesis using switches (e.g., valves such as MEMS valves) and one or more pressurized air sources. The discussed components may be used as loudspeakers, earpieces, integrated speakers, or the like and may be used over any suitable frequency range or ranges. For example, the discussed systems may use a pressurized air source and a valve or valves to generate an acoustic signal such that the valve or valves operate digitally at high frequency based on a modulation signal. The discussed devices and systems may offer the advantages of direct digital sound synthesis such that traditional digital-to-analog conversion and/or power amplifiers are not needed, high efficiency, and implementation in small (e.g., thin) structures that may provide flexibility to device and system designers.

FIG. 1 illustrates an example digital loudspeaker 100, arranged in accordance with at least some implementations of the present disclosure. As shown in FIG. 1, digital loudspeaker 100 may include an audio modulator 101, an air pressure source 102, one or more MEMS valves 103 coupled to (e.g., in fluid communication with) air pressure source 102 and coupled to (e.g., electrically and/or communicatively coupled to) audio modulator 101, and an acoustic combiner 104. Although illustrated and discussed with respect to MEMS valves 103, digital loudspeaker 100 may include non-MEMS valves in some embodiments. As shown, audio modulator 101 may receive an audio signal (AS) 111 and audio modulator 101 may provide one or more modulation signals (MSs) 113 to MEMS valves 103 such that audio modulator 101 may control MEMS valves 103 via modulation signals 113 to provide an acoustic output (AO) 115 from digital loudspeaker 100. For example, MEMS valves 103 may provide modulated air 114 via air 112 and based on control via modulation signals 113. As used herein, the term loudspeaker may include a loudspeaker of any dimensions, design form factors, or the like. For example, a loudspeaker may include an in-ear loudspeaker, a close-range loudspeaker implemented via a handheld device such as a smart phone or the like, a loudspeaker for home audio, a public address system, sound reinforcement system, or the like.

Audio signal 111 may be any suitable audio signal received via any suitable source such as a memory or a remote device. For example, audio signal 111 may be representative of an audio file or a streaming audio signal or the like. Modulation signals 113 may be generated using any suitable technique or techniques. In some embodiments, audio modulator 101 may directly digitally generate modulation signals 113 based on audio signal 111. As used herein, the term directly digitally or similar terms may be used to indicate that a digital signal is generated from another digital signal without intermediate conversion to an analog signal. Such processing in the context of generating modulation signals 113 based on audio signal 111 may provide advantages such as the elimination of digital-to-analog conversion, analog power amplification, and associated inefficiencies.

Modulation signals 113 may include any suitable modulation signals such as a pulse width modulation signal, a pulse density modulation signal, a pulse amplitude modulation signal, a pulse frequency modulation signal, a combination thereof, or the like. In some embodiments, all of modulation signals 113 may include the same modulation type. In other embodiments, modulation signals 113 may include different modulation types. Modulation signals 113 may provide timed ON/OFF signals to MEMS valves 103 such that MEMS valves 103 may provide acoustic output 115 to a user or users. For example, as shown, air pressure source 102 may provide air 112 (e.g., positive pressure air) to MEMS valves 103. Under the control of modulation signals 113, MEMS valves 103 may provide modulated air 114 (e.g., a modulated air stream or the like from each of MEMS valves 103), which may be combined to form acoustic output 115. For example, MEMS valves 103 (e.g., digital MEMS valves) may switch pressurized air flow on and off based on modulation signals 113 (e.g., control signals) from audio modulator 101. For example, modulation signals 113 may provide digital inputs to MEMS valves 103 such that an analog acoustic response (e.g., acoustic output 115) may be directly generated and provided to a user.

Audio modulator 101 may include an electrical system (e.g., implemented via hardware, firmware, software, or a combination thereof) that receives audio signal 111 as an input and outputs modulation signals 113 (e.g., one or more ON/OFF control signals) to control MEMS valves 103. In the illustrated embodiment, audio modulator 101 may generate a modulation signal for each of MEMS valves 103. In other embodiments, audio modulator 101 may generate a single modulation signal for all of MEMS valves 103 (e.g., such that the single modulation signal controls each of MEMS valves 103). In yet other embodiments, MEMS valves 103 may be separated into groups and a separate modulation signal may be generated for each group. For example, MEMS valves 103 may be separated into groups of two or more MEMS valves and a separate modulation signal may be generated for each group. Such MEMS valves groups may have the same or different numbers of MEMS valves. Each separate modulation signal may control all of the MEMS valves in a group. In some examples, the groups of MEMS valves 103 may include two, four, or eight MEMS valves, although groups may include any suitable number of MEMS valves. In some embodiments, MEMS valves 103 may include a high number of MEMS valves (e.g., 256 or more) each controlled by a separate modulation signal. Such embodiments may provide high quality acoustic output 115 (e.g., higher quality overall audio performance from digital loudspeaker 100).

Air pressure source 102 may include any suitable air pressure source such as a compressor, a pump, multiple pumps, or the like. In some embodiments, air pressure source 102 may include a MEMS air pressure source such as a piezoelectric MEMS pump, an electrostatic MEMS pump, a magnetic MEMS pump, or the like. For example, air pressure source 102 may generate mechanical movement using piezoelectric, electrostatic, or electromagnetic motors that may convert electrical power to mechanical movement. In some embodiments, air pressure source 102 may include a compressor topology. For example, air pressure source 102 may be a centrifugal compressor, an axial-flow compressor, a rotary vane compressor, a scroll compressor, a diaphragm compressor, a piston compressor, or the like. In some embodiments, air pressure source 102 may generate pressure using non-mechanical movement techniques such as combustion of a burning material in a closed pressure chamber, boiling a liquid (e.g., water) to generate pressurized gas (e.g., via steam), electrolysis of a liquid (e.g., converting water to hydrogen and oxygen), or the like.

As used herein the term MEMS pump may indicate a pump or compressor having dimensions not greater than about one cubic centimeter. Such MEMS pumps may be advantageous in mobile device implementations for example. In other embodiments, air pressure source 102 may include a full size (e.g., non-MEMS) pump. In some embodiments, air pressure source 102 may be provided as a separate device or system with respect to digital loudspeaker. In some embodiments, it may be advantageous to locate at least the pump portion of air pressure source 102 remotely from MEMS valves 103 and acoustic output 115 (e.g., such that any undesirable noise from the pump may be mitigated). As is discussed further herein, in some embodiments air pressure source 102 may include an air pump in fluid communication with a pressure chamber that is in fluid communication with MEMS valves 103 (e.g., with inlets of MEMS valves 103). In some embodiments, particularly close range loudspeaker implementation such as ear buds or the like, air 112 may be provided at a pressure of about 30 Pa, although any suitable supply pressure may be employed.

As shown, in some embodiments, digital loudspeaker 100 may include acoustic combiner 104. In other embodiments, digital loudspeaker 100 may not include acoustic combiner 104. For example, acoustic combiner 104 may not be needed when MEMS valves 103 are in close proximity to one another and/or in the same air space. Furthermore, MEMS valves 103 may operate at a high frequency that is above the human hearing frequency range. For example, acoustic output 115 may include an intentional analog signal in the human hearing range (e.g., the desired audio output of digital loudspeaker 100) and switching noise from MEMS valves 103 that are inaudible and do not have adverse effects for a user or user of digital loudspeaker 100.

In other embodiments, acoustic combiner 104 may include a front cavity in fluid communication with MEMS valves 103 (e.g., in fluid communication with outlets of MEMs valves 103). Such a front cavity may provide an acoustic structure that provides for the combining and/or filtering of modulated air 114. Such filtering may remove all or a portion of the switching noise associated with MEMS valves 103. The front cavity may include any suitable structure for providing such combining and/or filtering. For example, the front cavity may be a Helmholtz resonator or the like to remove high frequency switching noise from MEMS valves 103.

Digital loudspeaker 100 may include any number of MEMS valves 103 such as one to 512 MEMS valves or the like. MEMS valves 103 may all have the same characteristics (e.g., they may be identical) or one or more of MEMS valves 103 may have different properties or characteristics with respect to other MEMS valves. Such properties or characteristics may include air flow characteristics, size, shape, inlet size or shape, outlet size or shape, MEMS valve type, or the like of MEMS valves 103. For example, a MEMS valve of MEMS valves 103 may have at least one property or characteristic different than the characteristics of one or more of other MEMS valves of MEMS valves 103. MEMS valves 103 may have any suitable dimensions depending on the pressure and/or air flow of air 112. In some embodiments, MEMS valves 103 may have a size that provides for high frequency switching such that any switching noise generated by MEMS valves 103 is at a frequency greater than the human hearing range (e.g., greater than about 20 kHz). In some embodiments, MEMS valves 103 may have a size less than about one square millimeter.

Digital loudspeaker 100 may be implemented via any suitable system or device or the like and in any suitable configuration. In an embodiment, MEMS valves 103 and audio modulator 101 may be disposed on a single die (e.g., a semiconductor die or the like) to form a monolithic device. Such an implementation may provide a small size for implementation via a laptop computer, a tablet, a smart phone, a wearable device (e.g., a watch or glasses or the like), or the like. In some embodiments, digital loudspeaker 100 may be implemented via an ultrasonic gesture sensing device or a system implementing such an ultrasonic gesture sensing device. For example, acoustic output 115 may be tuned to provide an ultrasonic acoustic that may be provided to a scene or the like and a response to acoustic output 115 may be sensed via a sensor to provide object detection data, object recognition data, gesture recognition data, or the like.

Figure 2:
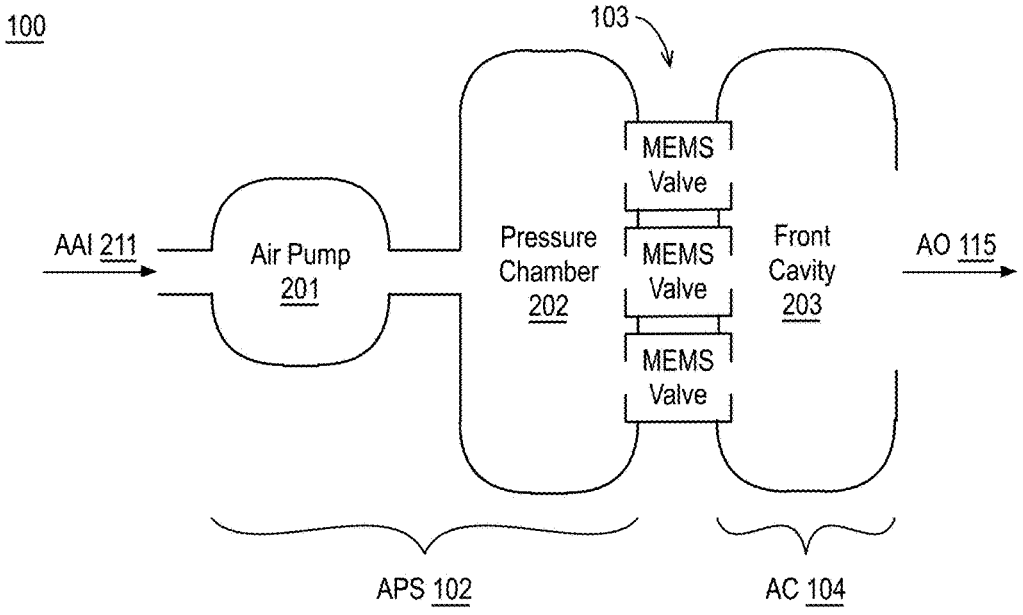
FIG. 2 illustrates an example digital loudspeaker in the mechanical/acoustic domain.

FIG. 2 illustrates example digital loudspeaker 100 in the mechanical/acoustic domain, arranged in accordance with at least some implementations of the present disclosure. As discussed with respect to FIG. 1 and as shown in FIG. 2, digital loudspeaker 100 may include air pressure source 102, MEMS valves 103, and acoustic combiner 104. As shown, in some embodiments, air pressure source 102 may include an air pump 201 and a pressure chamber 202 in fluid communication with air pump 201 and MEMS valves 103. Also as shown, in some embodiments, acoustic combiner 104 may include a front cavity 203 in fluid communication with MEMS valves 103.

As discussed, air pump 201 may include any suitable compressor or pump such as a MEMS pump (e.g., a piezoelectric MEMS pump, an electrostatic MEMS pump, a magnetic MEMS pump, or the like) or a full size pump or the like. Air pump 201 may receive or pull ambient air intake (AAI) 211 via an ambient air inlet and provide pressurized air to pressure chamber 202. Pressure chamber 202 may have any suitable size and shape and may be in fluid communication with MEMS valves 103 (e.g., inlets of MEMS valves 103) to provide pressurized air (e.g., air 112, please refer to FIG. 1) that may be modulated to generate acoustic output 115.

MEMS valves 103 may be operated under the control of one or more modulation signals provided via an audio modulator to provide modulated air, as discussed, to optional front cavity 203. Front cavity 203 may, in some embodiments, combine modulated air from MEMS valves 103 and/or filter high frequency (e.g., inaudible) switching noise generated by MEMS valves 103 to provide acoustic output 115. Front cavity 203 may include any suitable shape and structure for providing such combining and/or filtering. For example, front cavity 203 may be a Helmholtz resonator or the like to remove high frequency switching noise from MEMS valves 103. As discussed, in some embodiments, front cavity 203 may not be provided.

As discussed, in some embodiments, digital loudspeaker 100 may have a high pressure air source (e.g., air pressure source 102) to generate acoustic output 115. Such embodiments may provide ease of implementation and high quality acoustic output 115 at low cost and high efficiency. In other embodiments, a digital loudspeaker may also include a low or negative pressure air source such that both high and low pressure signals may be provided to generate an acoustic output. Such embodiments may eliminate modulation challenges caused by providing a pressure offset when only a high pressure air source (e.g., higher than atmospheric pressure) is provided, as is discussed further herein with respect to FIGS. 6 and 7.

Figure 3:
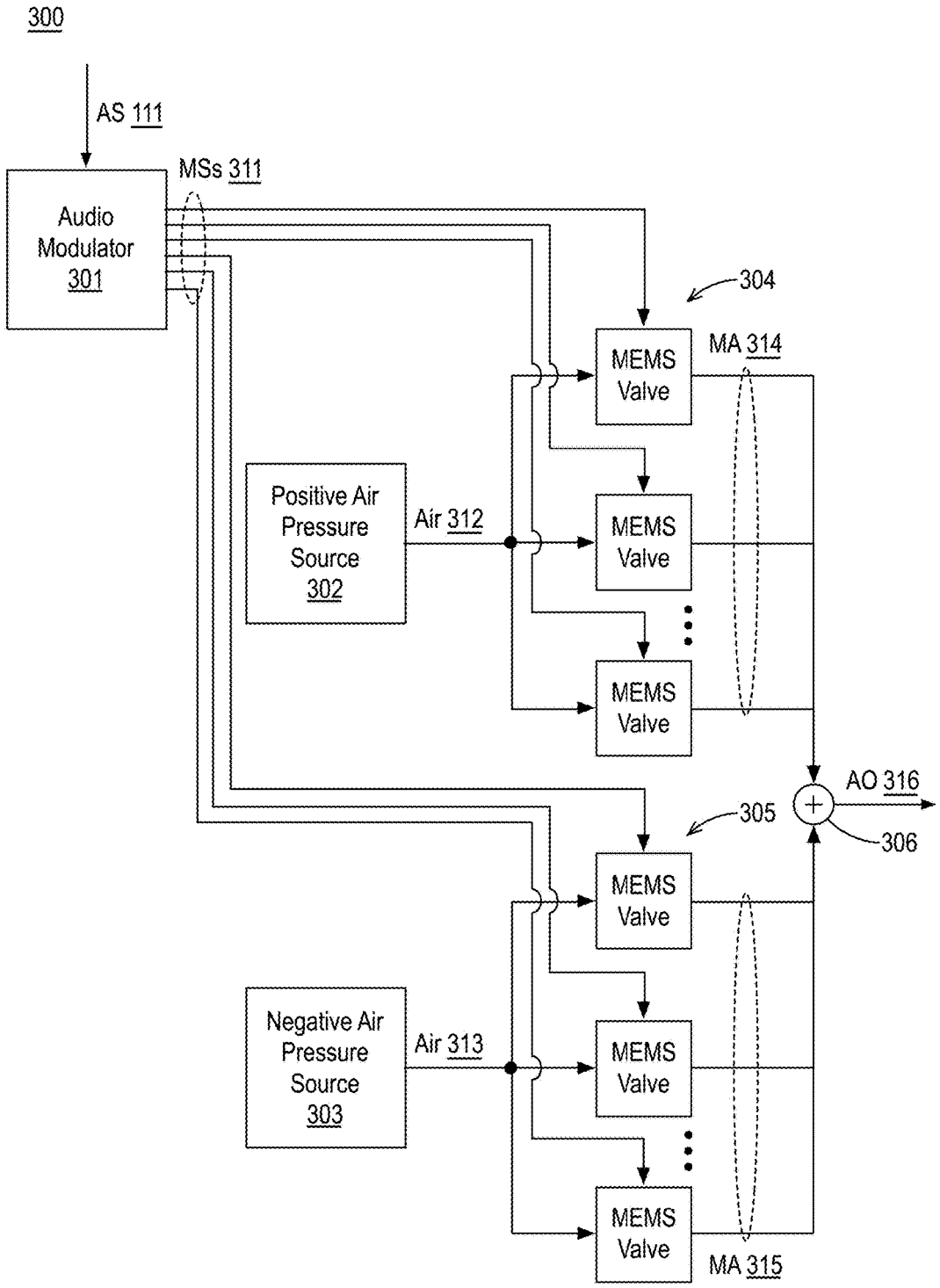
FIG. 3 illustrates an example digital loudspeaker.

FIG. 3 illustrates an example digital loudspeaker 300, arranged in accordance with at least some implementations of the present disclosure. As shown in FIG. 3, digital loudspeaker 300 may include an audio modulator 301, a positive air pressure source 302, one or more MEMS valves 304 coupled to (e.g., in fluid communication with) positive air pressure source 302 and coupled to (e.g., electrically and/or communicatively coupled to) audio modulator 301, a negative air pressure source 303, one or more MEMS valves 305 coupled to (e.g., in fluid communication with) negative air pressure source 303 and coupled to (e.g., electrically and/or communicatively coupled to) audio modulator 301, and an acoustic combiner 306. As shown, audio modulator 301 may receive audio signal (AS) 111 and audio modulator 301 may provide one or more modulation signals (MSs) 311 to MEMS valves 304 and MEMS valves 305 such that audio modulator 301 may control MEMS valves 304 and MEMS valves 305 to provide an acoustic output (AO) 316 from digital loudspeaker 300. Although illustrated and discussed with respect to MEMS valves 304, 305, digital loudspeaker 300 may include non-MEMS valves in some embodiments. Digital loudspeaker 300 may provide for dual air pressure sources (e.g., high and low or positive and negative) to eliminate or mitigate modulation challenges as is discussed further herein.

Audio signal 111 may be any suitable audio signal as discussed herein and modulation signals 311 may be generated using any suitable technique or techniques such as audio modulator 301 directly digitally generating modulation signals 311 based on audio signal 111. Modulation signals 311 may include any suitable modulation signals such as a pulse width modulation signal, a pulse density modulation signal, a pulse amplitude modulation signal, a pulse frequency modulation signal, a combination thereof, or the like. In some embodiments, all of modulation signals 311 may include the same modulation type and, in other embodiments, modulation signals 113 may include different modulation types. Modulation signals 311 may provide timed ON/OFF signals to MEMS valves 304 and MEMS valves 305 such that acoustic output 316 may be provided to a user or users.

As shown, positive air pressure source 302 may provide air 312 (e.g., positive pressure air with respect to ambient air pressure) to MEMS valves 304 and negative air pressure source 303 may provide air 313 (e.g., negative pressure air with respect to ambient air pressure) to MEMS valves 305. For example, negative air pressure source 303 may pull air from MEMS valves 305. Under the control of modulation signals 311, MEMS valves 304 may provide modulated air 314 and MEMS valves 305 may provide modulated air 315, which may be combined to form acoustic output 316.

As discussed with respect to audio modulator 101, audio modulator 301 may include an electrical system that receives audio signal 111 as an input and outputs modulation signals 311 to control MEMS valves 304 and MEMS valves 305. In the illustrated embodiment, audio modulator 301 generates a modulation signal for each of MEMS valves 304 and MEMS valves 305. In other embodiments, audio modulator 301 may generate a first modulation signal for all of MEMS valves 304 and a second modulation signal for all of MEMS valves 305. In yet other embodiments, MEMS valves 304 and/or MEMS valves 305 may be separated into groups and separate modulation signals may be generated for each group. For example, MEMS valves 304 and/or MEMS valves 305 may be separated into groups of two or more MEMS valves and a separate modulation signal may be generated for each group. Such MEMS valves groups may have the same or different numbers of MEMS valves and each separate modulation signal may control all of the MEMS valves in a group.

Figure 4:
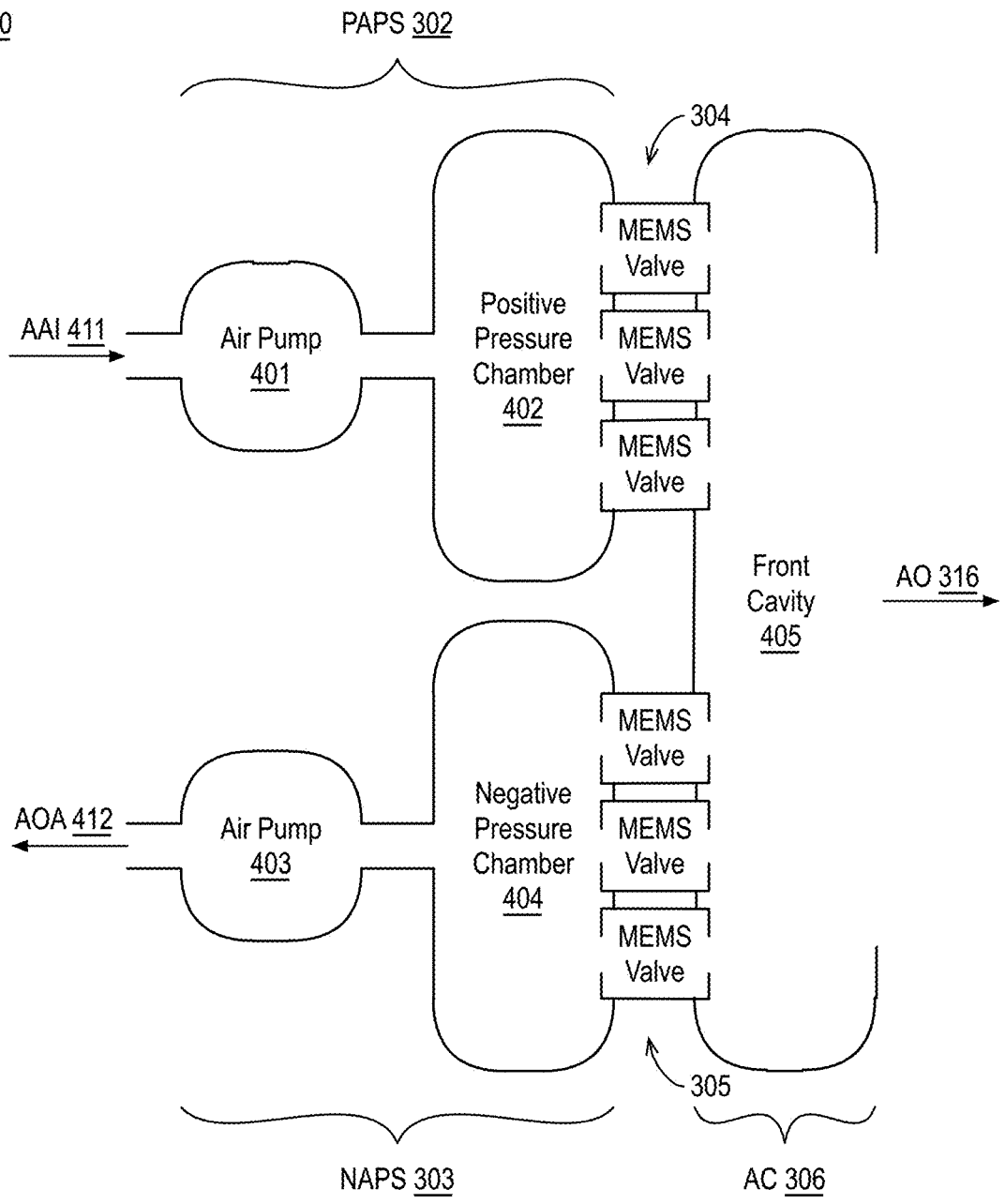
FIG. 4 illustrates an example digital loudspeaker with separate positive and negative air pumps in the mechanical/acoustic domain.
Figure 5:
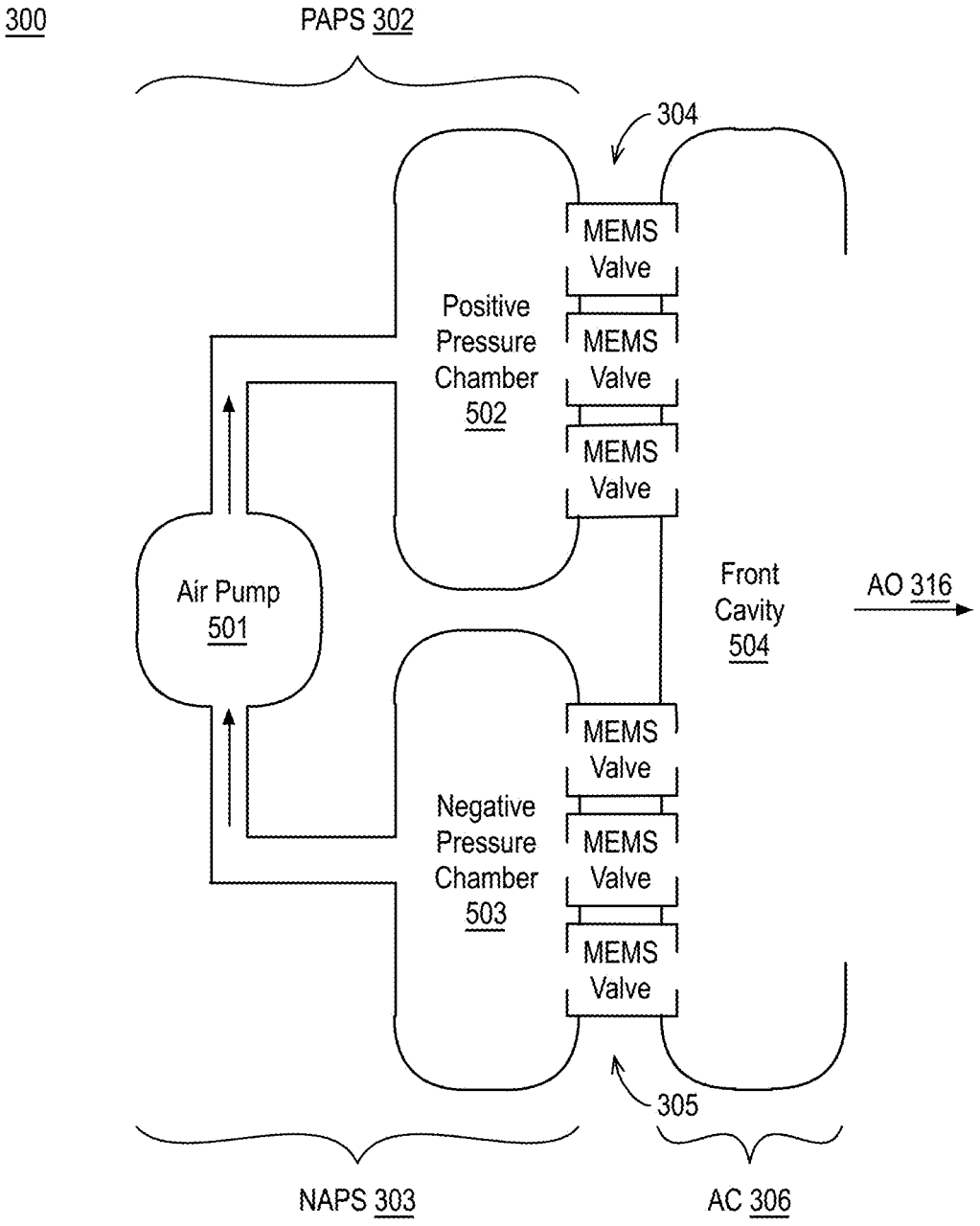
FIG. 5 illustrates an example digital loudspeaker with a shared air pump in the mechanical/acoustic domain.

Positive air pressure source 302 and negative air pressure source 303 may include any suitable air pressure sources such as separate compressors or pumps, a shared compressor or pump, pressure chambers, or the like as discussed with respect to FIG. 1 and as is discussed further with respect to FIGS. 4 and 5. As shown, in some embodiments, digital loudspeaker 300 may include acoustic combiner 306. In other embodiments, acoustic combiner 306 may not be used. As discussed with respect to acoustic combiner 104, acoustic combiner 306 may not be needed when MEMS valves 304 and MEMS valves 305 are in close proximity to one another and in the same air space. In other embodiments, acoustic combiner 306 may include a front cavity in fluid communication with MEMS valves 304 and MEMS valves 305 and acoustic combiner 306 may provide an acoustic structure that provides for the combining and/or filtering of modulated air 314 and modulated air 315. Such filtering may remove all or a portion of the switching noise associated with MEMS valves 304 and MEMS valves 305. The front cavity may include any suitable structure for providing such combining and/or filtering. For example, the front cavity may be a Helmholtz resonator or the like to remove high frequency switching noise from MEMS valves 304 and MEMS valves 305.

Digital loudspeaker 300 may include any number of MEMS valves 304 and MEMS valves 305 such as one to 512 MEMS valves 304 and one to 512 MEMS valves 305 or the like. MEMS valves 304 and MEMS valves 305 may all have the same characteristics (e.g., they may be identical) or one or more of MEMS valves 304 and MEMS valves 305 may have different properties or characteristics (e.g., air flow characteristics, size, shape, inlet size or shape, outlet size or shape, MEMS valve type, or the like) with respect to other MEMS valves. In an embodiment, MEMS valves 304 are all of a first type (e.g., identical to one another) and MEMS valves 305 are of a second (e.g., identical to one another but different than MEMS valves 304). Digital loudspeaker 300 may have the same number of MEMS valves 304 and MEMS valves 305 or the number of MEMS valves 304 may be different than the number of MEMS valves 305.

Digital loudspeaker 300 may be implemented via any suitable system or device or the like and in any suitable configuration as discussed with respect to digital loudspeaker 100 or elsewhere herein. As discussed, positive air pressure source 302 and negative air pressure source 303 may include any suitable air pressure sources such as separate pumps or a shared pump.

FIG. 4 illustrates example digital loudspeaker 300 with separate positive and negative air pumps in the mechanical/acoustic domain, arranged in accordance with at least some implementations of the present disclosure. As shown in FIG. 4, digital loudspeaker 300 may include positive air pressure source 302 including an air pump 401 and a positive pressure chamber 402, MEMS valves 304, negative air pressure source 303 including an air pump 403 and a negative pressure chamber 404, MEMS valves 305, and acoustic combiner 306 including a front cavity 405 in fluid communication with MEMS valves 304 and MEMS valves 305.

Air pump 401 and air pump 403 may include any air compressors or pumps as discussed herein such as piezoelectric MEMS pumps, electrostatic MEMS pumps, magnetic MEMS pumps, or the like. For example, air pump 401 and/or air pump 403 may generate mechanical movement using piezoelectric, electrostatic, or electromagnetic motors that may convert electrical power to mechanical movement. In some embodiments, air pump 401 and/or air pump 403 may include a compressor topology. For example, air pump 401 and/or air pump 403 may be a centrifugal compressor, an axial-flow compressor, a rotary vane compressor, a scroll compressor, a diaphragm compressor, a piston compressor, or the like. Although illustrated and discussed with respect to air pumps, in some embodiments, positive and negative air pressure sources 302, 303 may generate pressure using non-mechanical movement techniques such as combustion of a burning material in a closed pressure chamber, boiling a liquid, electrolysis of a liquid, or the like. In some embodiments, air pump 401 and air pump 403 may be full size (e.g., non-MEMS) pumps. In some embodiments, pump 401 and air pump 403 may be the same type of pumps and, in other embodiments, they may be different. As shown, air pump 401 may receive or pull ambient air intake (AAI) 411 via an ambient air inlet. Air pump 401 may be in fluid communication with positive pressure chamber 402 and air pump 401 and provide pressurized air to positive pressure chamber 402. Positive pressure chamber 402 may have any suitable size and shape and may be in fluid communication with MEMS valves 304 (e.g., inlets of MEMS valves 304) to provide pressurized air (e.g., air 312, please refer to FIG. 3) that may be modulated via MEMS valves 304.

Air pump 403 may pull pressure (e.g., provide negative pressure) on MEMS valves 305 such that MEMS valves 305 pull air from front cavity 405 (e.g., provide negative modulated air 315, please refer to FIG. 3) to negative pressure chamber 404, and air pump 403 releases air outlet to ambient (AOA) 412. For example, air pump 403 may be in fluid communication with negative pressure chamber 404 to pull air from MEMS valves 305 via negative pressure chamber 404. Negative pressure chamber 404 may have any suitable size and shape and may be in fluid communication with MEMS valves 305 (e.g., outlets of MEMS valves 305) to pull air such that a negative pressure modulation may be provided via modulated air 315, please refer to FIG. 3.

MEMS valves 304 and MEMS valves 305 may be operated under the control of one or more modulation signals provided via an audio modulator to provide positive pressure modulated air and negative pressure modulated, respectively, to optional front cavity 405. Front cavity 405 may, in some embodiments, combine modulated air from MEMS valves 304 and MEMS valves 305 and/or filter high frequency (e.g., inaudible) switching noise generated by MEMS valves 304 and MEMS valves 305 to provide acoustic output 316. As discussed, in some embodiments, front cavity 405 may not be provided.

FIG. 5 illustrates example digital loudspeaker 300 with a shared air pump in the mechanical/acoustic domain, arranged in accordance with at least some implementations of the present disclosure. As shown in FIG. 5, digital loudspeaker 300 may include positive air pressure source 302 including an air pump 501 and a positive pressure chamber 502, negative air pressure source 303 including an air pump 501 and a negative pressure chamber 503, MEMS valves 304, MEMS valves 305, and acoustic combiner 306 including a front cavity 504 in fluid communication with MEMS valves 304 and MEMS valves 305.

Air pump 501 may include any air compressors or pumps as discussed herein such as piezoelectric MEMS pumps, electrostatic MEMS pumps, magnetic MEMS pumps, or the like. For example, air pump 501 may generate mechanical movement using piezoelectric, electrostatic, or electromagnetic motors that may convert electrical power to mechanical movement. In some embodiments, air pump 501 may include a compressor topology. For example, air pump 501 may be a centrifugal compressor, an axial-flow compressor, a rotary vane compressor, a scroll compressor, a diaphragm compressor, a piston compressor, or the like. In some embodiments, air pump 501 may be a full size (e.g., non-MEMS) pump. As shown, air pump 501 may be in fluid communication with positive pressure chamber 502 and negative pressure chamber 503. For example, air pump 501 may provide positive pressurized air (e.g., air 312, please refer to FIG. 3) to positive pressure chamber 402 and negative pressurized air (e.g., air 313) to negative pressure chamber 404. Positive pressure chamber 402 may have any suitable size and shape and may be in fluid communication with MEMS valves 304 (e.g., inlets of MEMS valves 304) to provide pressurized air that may be modulated. Negative pressure chamber 404 may have any suitable size and shape and may be in fluid communication with MEMS valves 305 (e.g., outlets of MEMS valves 305) to pull air such that a negative pressure modulation may be provided via modulated air 315, please refer to FIG. 3.

As discussed, MEMS valves 304 and MEMS valves 305 may be operated under the control of one or more modulation signals provided via an audio modulator to provide positive pressure modulated air and negative pressure modulated, respectively, to optional front cavity 504, which may, in some embodiments, combine modulated air from MEMS valves 304 and MEMS valves 305 and/or filter high frequency (e.g., inaudible) switching noise generated by MEMS valves 304 and MEMS valves 305 to provide acoustic output 316. In some embodiments, front cavity 504 may not be provided.

Figure 6:
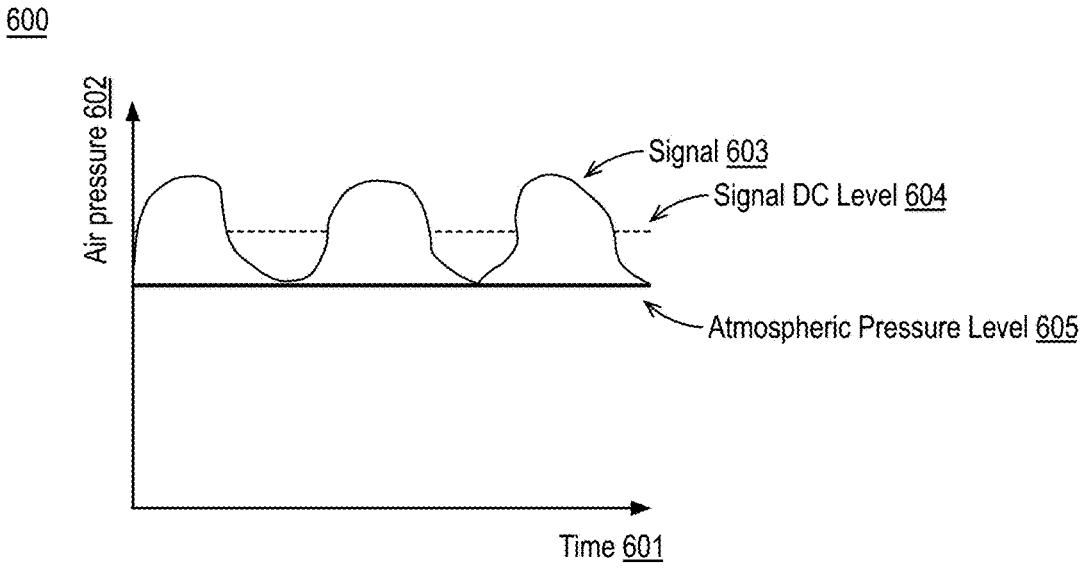
FIG. 6 illustrates an example chart of acoustic signaling for a single positive pressure source digital loudspeaker.

FIG. 6 illustrates an example chart 600 of acoustic signaling for a single positive pressure source digital loudspeaker, arranged in accordance with at least some implementations of the present disclosure. For example, chart 600 may illustrate an example acoustic signal 603 from digital loudspeaker 100. As shown in FIG. 6, chart 600 illustrates air pressure 602 over time 601 such that acoustic signal 603 may be produced with all of acoustic signal 603 being above an atmospheric pressure level 605 (e.g., only a positive pressure source may be available via digital loudspeaker 100). In such examples, a signal DC level 604 (e.g., an offset) may be provided to acoustic signal 603 to avoid clipping or the like.

Figure 7:
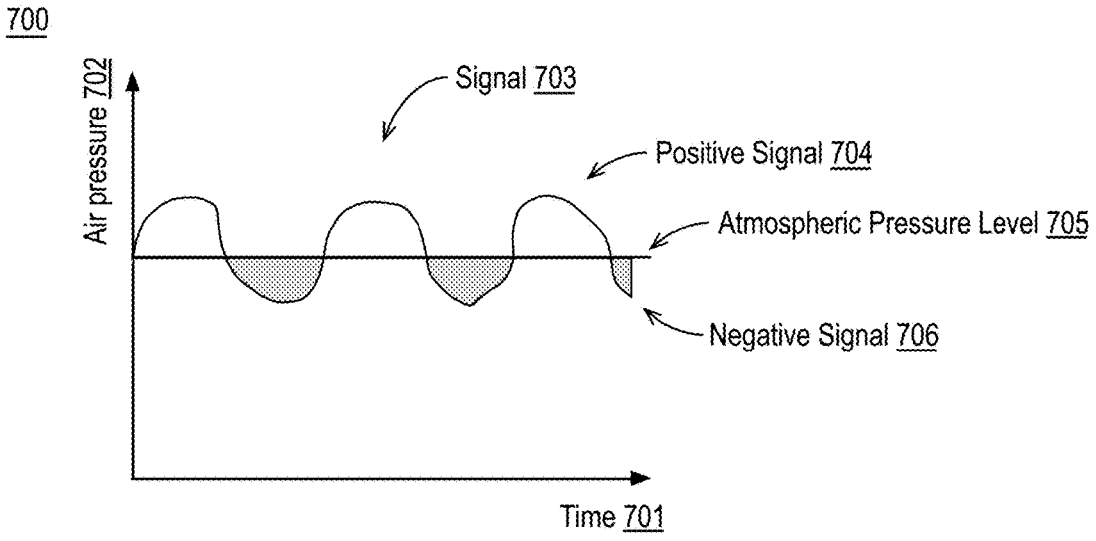
FIG. 7 illustrates an example chart of acoustic signaling for a dual pressure source digital loudspeaker.

FIG. 7 illustrates an example chart 700 of acoustic signaling for a dual pressure source digital loudspeaker, arranged in accordance with at least some implementations of the present disclosure. For example, chart 700 may illustrate an example acoustic signal 703 from digital loudspeaker 300. As shown in FIG. 7, chart 700 illustrates air pressure 702 over time 701 such that acoustic signal 703 may be produced with acoustic signal including a positive signal 704 (e.g., a portion of acoustic signal 703 above an atmospheric pressure level 705) and a negative signal 706 (e.g., a portion of acoustic signal 703 below atmospheric pressure level 705). In such examples, a signal DC level (e.g., an offset) may not be needed.

Figure 8:
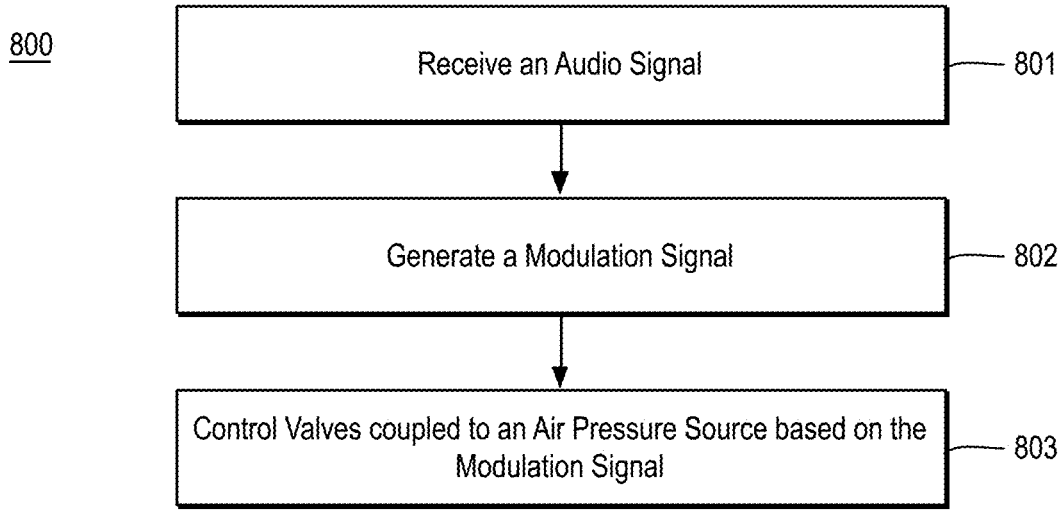
FIG. 8 is a flow diagram illustrating an example process for providing an acoustic output from a digital loudspeaker.

FIG. 8 is a flow diagram illustrating an example process 800 for providing an acoustic output from a digital loudspeaker, arranged in accordance with at least some implementations of the present disclosure. Process 800 may include one or more operations 801-803 as illustrated in FIG. 8. Process 800 may form at least part of an acoustic output process. By way of non-limiting example, process 800 may form at least part of an acoustic output process as performed by digital loudspeaker 100, digital loudspeaker 300, or any other device or system discussed herein. Furthermore, process 800 will be described herein with reference to system 900 of FIG. 9.

Figure 9:
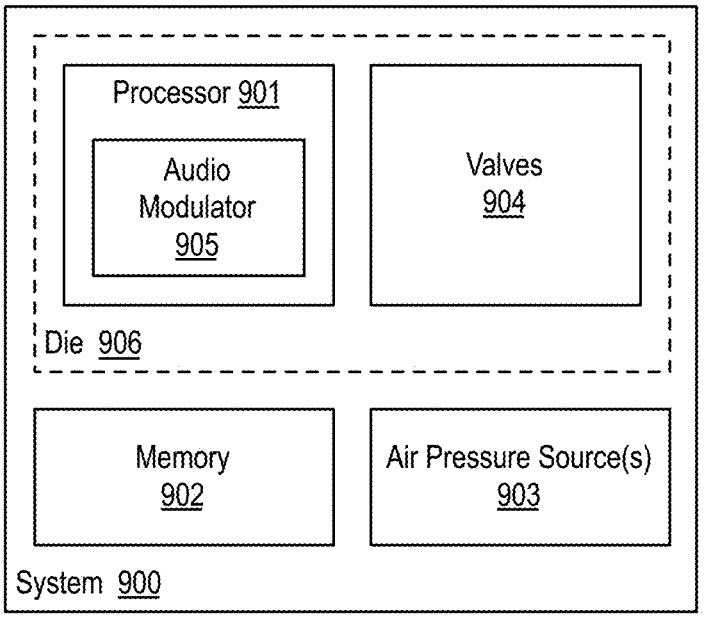
FIG. 9 is an illustrative diagram of an example system for providing an acoustic output from a digital loudspeaker.

FIG. 9 is an illustrative diagram of an example system 900 for providing an acoustic output from a digital loudspeaker, arranged in accordance with at least some implementations of the present disclosure. As shown in FIG. 9, system 900 may include one or more processors 901 implementing an audio modulator 905, one or more valves 904, a memory 902, and one or more air pressure source(s) 903. Also as shown, in some embodiments, processor 901 implementing audio modulator 905 and valves 904 may be disposed on a die 906 (e.g., a single die such as a semiconductor die) to form a monolithic device. In some embodiments, such a monolithic device may be housed within a speaker. For example, system 900 may be a laptop computer, a tablet, a smart phone or the like, and the speaker may be implemented as a component of system 900. In the example of system 900, memory 902 may store audio or related data or content such as audio signal 111, modulation parameters, and/or any other data as discussed herein.

As shown, in some embodiments, audio modulator 905 may be implemented via processor 901. For example, audio modulator 905 may be driver implemented via any level of a software stack to provide a modulation signal to valves 904. In some embodiments, audio modulator 905 may be implemented via an audio signal processor, dedicated hardware, fixed function circuitry, an execution unit or units, or the like. Fixed function circuitry may include, for example, dedicated logic or circuitry and may provide a set of fixed function entry points that may map to the dedicated logic for a fixed purpose or function. An execution (EU) may include, for example, programmable logic or circuitry such as a logic core or cores that may provide a wide array of programmable logic functions. Processor 901 may include any number and type of processing units or modules that may provide control and other high level functions for system 900 and/or provide any modulation signaling as discussed herein. Memory 902 may be any type of memory such as volatile memory (e.g., Static Random Access Memory (SRAM), Dynamic Random Access Memory (DRAM), etc.) or non-volatile memory (e.g., flash memory, etc.), and so forth. In an embodiment, memory 902 may be implemented via cache memory.

Valves 904 and air pressure source(s) 903 may include any valves, MEMS valves, air pressure sources, and configurations of such components as discussed herein. For example, valves 904 may include any characteristics as discussed with respect to MEMS valves 103, 304, 305 and air pressure source(s) 903 may include any characteristics as discussed with respect to air pressure sources 102, 302, 303. Furthermore, valves 904 and air pressure source(s) 903 may be provided in any configuration such as those discussed with respect to digital loudspeakers 100, 300.

Returning to discussion of FIG. 8, process 800 may begin at operation 801, "Receive an Audio Signal", where an audio signal may be received. In an embodiment, audio modulator 905 as implemented via processor 901 may receive any audio signal as discussed herein using any suitable technique or techniques. In some embodiments, the audio signal may be received from memory 902. In some embodiments, the audio signal may be received via a remote device in communication with system 900.

Process 800 may continue at operation 802, "Generate a Modulation Signal", where a modulation signal may be generated based on the received audio signal. The modulation signal may be generated using any suitable technique or techniques. In an embodiment, audio modulator 905 as implemented via processor 901 may generate a modulation signal or signals such as modulation signals 113 or modulation signals 311 as discussed herein. The modulation signal or signals may include any suitable modulation for controlling valves 904. For example, the modulation signal or signals may include one or more of a pulse width modulation signal, a pulse density modulation signal, a pulse amplitude modulation signal, or a pulse frequency modulation signal. In an embodiment, the modulation signals may include a separate modulation signal for each of valves 904. In another embodiment, the modulation signals may include separate modulation signals for different groups of valves 904. For example, valves 904 may include a first and second groups of valves and the modulation signals may include a first modulation signal to control all of the valves in the first group and a second modulation signal to control all of the valves in the second group. In an embodiment, the modulation signal may be directly digitally generated based on the audio signal.

Process 800 may continue at operation 803, "Control Valves coupled to an Air Pressure Source based on the Modulation Signal", where one or more valves that are coupled to an air pressure source may be controlled based on the modulation signal to provide an acoustic output. In some embodiments, the one or more valves may be MEMS valves. For example, valves 904 may be coupled to air pressure source(s) 903 and valves 904 may be controlled based on the modulation signal generated at operation 802 to provide an acoustic output such as acoustic output 115, acoustic output 316, or the like.

System 900 may have any suitable size and may be any suitable form factor. For example, system 900 may be a laptop computer, a tablet, a smart phone, a mobile audio device, a wearable device such as glasses or a watch, wireless or wired ear buds, or the like. In some embodiments, system 900 may be an ultrasonic gesture sensing device or system. Process 800 may be repeated any number of times either in series or in parallel to provide an acoustic output.

Various components of the systems described herein, such as an audio modulator, may be implemented in software, firmware, and/or hardware and/or any combination thereof. Furthermore, various components of digital loudspeakers 100, 300 or systems 900, 1000, or device 1100 may be provided, at least in part, by hardware of a computing System-on-a-Chip (SoC) such as may be found in a computing system such as, for example, an audio system. Those skilled in the art may recognize that systems described herein may include additional components that have not been depicted in the corresponding figures. For example, the systems discussed herein may include additional components such as additional audio hardware, audio cards, speakers, microphones, audio interfaces or the like that have not been depicted in the interest of clarity.

While implementation of the example processes discussed herein may include the undertaking of all operations shown in the order illustrated, the present disclosure is not limited in this regard and, in various examples, implementation of the example processes herein may include only a subset of the operations shown, operations performed in a different order than illustrated, or additional operations.

In addition, any one or more of the operations discussed herein may be undertaken in response to instructions provided by one or more computer program products. Such program products may include signal bearing media providing instructions that, when executed by, for example, a processor, may provide the functionality described herein. The computer program products may be provided in any form of one or more machine-readable media. Thus, for example, a processor including one or more processor core(s) may undertake one or more of the blocks of the example processes herein in response to program code and/or instructions or instruction sets conveyed to the processor by one or more machine-readable media. In general, a machine-readable medium may convey software in the form of program code and/or instructions or instruction sets that may cause any of the devices and/or systems described herein to implement at least portions of the components, devices, and systems as discussed herein.

As used in any implementation described herein, the terms module and component and the like refer to any combination of software logic, firmware logic, hardware logic, and/or circuitry configured to provide the functionality described herein. The software may be embodied as a software package, code and/or instruction set or instructions, and "hardware", as used in any implementation described herein, may include, for example, singly or in any combination, hardwired circuitry, programmable circuitry, state machine circuitry, fixed function circuitry, execution unit circuitry, and/or firmware that stores instructions executed by programmable circuitry. The modules may, collectively or individually, be embodied as circuitry that forms part of a larger system, for example, an integrated circuit (IC), system on-chip (SoC), and so forth.

Figure 10:
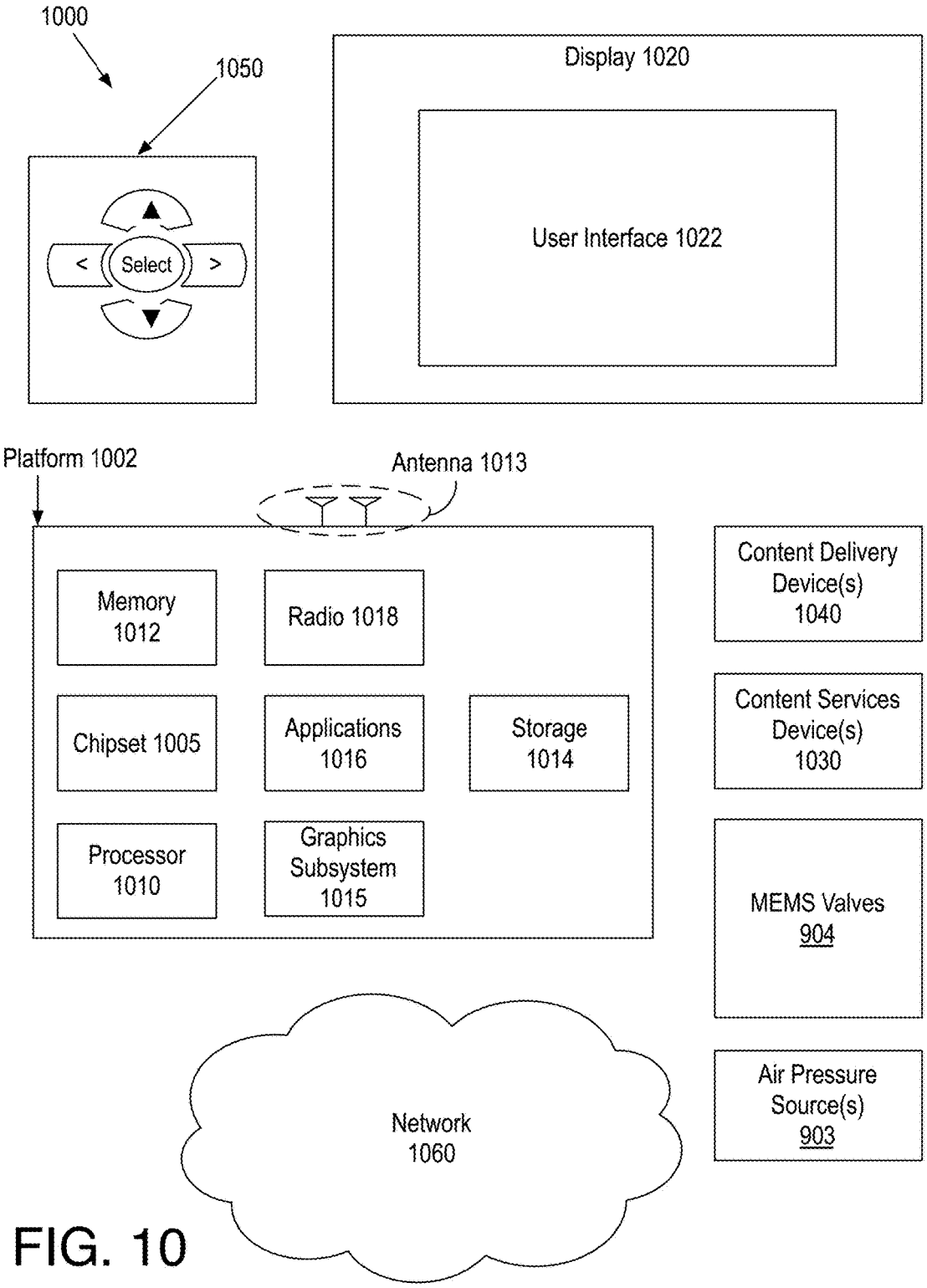
FIG. 10 is an illustrative diagram of an example system.

FIG. 10 is an illustrative diagram of an example system 1000, arranged in accordance with at least some implementations of the present disclosure. In various implementations, system 1000 may be an audio system or a media system although system 1000 is not limited to this context. For example, system 1000 may be incorporated into a personal computer (PC), laptop computer, ultra-laptop computer, tablet, touch pad, portable computer, handheld computer, palmtop computer, personal digital assistant (PDA), cellular telephone, combination cellular telephone/PDA, television, smart device (e.g., smart phone, smart tablet or smart television), mobile internet device (MID), messaging device, data communication device, camera, and so forth.

In various implementations, system 1000 includes a platform 1002 coupled to an optional display 1020. Platform 1002 may receive content from a content device such as content services device(s) 1030 or content delivery device(s) 1040 or other similar content sources. An optional navigation controller 1050 including one or more navigation features may be used to interact with, for example, platform 1002 and/or display 1020. Each of these components is described in greater detail below.

In various implementations, platform 1002 may include any combination of a chipset 1005, processor 1010, memory 1012, antenna 1013, storage 1014, graphics subsystem 1015, applications 1016 and/or radio 1018. Chipset 1005 may provide intercommunication among processor 1010, memory 1012, storage 1014, graphics subsystem 1015, applications 1016 and/or radio 1018. For example, chipset 1005 may include a storage adapter (not depicted) capable of providing intercommunication with storage 1014.

Processor 1010 may be implemented as a Complex Instruction Set Computer (CISC) or Reduced Instruction Set Computer (RISC) processors, x86 instruction set compatible processors, multi-core, or any other microprocessor or central processing unit (CPU). In various implementations, processor 1010 may be dual-core processor(s), dual-core mobile processor(s), and so forth. In some embodiments, processor 1010 or another processing unit may implement an audio modulator as discussed herein. Furthermore, system 1000 may include MEMS valves 904 and/or air pressure sources 903 as discussed herein.

Memory 1012 may be implemented as a volatile memory device such as, but not limited to, a Random Access Memory (RAM), Dynamic Random Access Memory (DRAM), or Static RAM (SRAM).

Storage 1014 may be implemented as a non-volatile storage device such as, but not limited to, a magnetic disk drive, optical disk drive, tape drive, an internal storage device, an attached storage device, flash memory, battery backed-up SDRAM (synchronous DRAM), and/or a network accessible storage device. In various implementations, storage 1014 may include technology to increase the storage performance enhanced protection for valuable digital media when multiple hard drives are included, for example.

Graphics subsystem 1015 may perform processing of images such as still or video for display. Graphics subsystem 1015 may be a graphics processing unit (GPU) or a visual processing unit (VPU), for example. An analog or digital interface may be used to communicatively couple graphics subsystem 1015 and display 1020. For example, the interface may be any of a High-Definition Multimedia Interface, DisplayPort, wireless HDMI, and/or wireless HD compliant techniques. Graphics subsystem 1015 may be integrated into processor 1010 or chipset 1005. In some implementations, graphics subsystem 1015 may be a stand-alone device communicatively coupled to chipset 1005.

The audio processing techniques described herein may be implemented in various hardware architectures. For example, audio processing functionality may be integrated within a chipset. Alternatively, a discrete audio and/or media processor may be used. As still another implementation, the audio processing functions may be provided by a general purpose processor, including a multi-core processor. In further embodiments, the functions may be implemented in a consumer electronics device.

Radio 1018 may include one or more radios capable of transmitting and receiving signals using various suitable wireless communications techniques. Such techniques may involve communications across one or more wireless networks. Example wireless networks include (but are not limited to) wireless local area networks (WLANs), wireless personal area networks (WPANs), wireless metropolitan area network (WMANs), cellular networks, and satellite networks. In communicating across such networks, radio 1018 may operate in accordance with one or more applicable standards in any version.

In various implementations, display 1020 may include any television type monitor or display. Display 1020 may include, for example, a computer display screen, touch screen display, video monitor, television-like device, and/or a television. Display 1020 may be digital and/or analog. In various implementations, display 1020 may be a holographic display. Also, display 1020 may be a transparent surface that may receive a visual projection. Such projections may convey various forms of information, images, and/or objects. For example, such projections may be a visual overlay for a mobile augmented reality (MAR) application. Under the control of one or more software applications 1016, platform 1002 may display user interface 1022 on display 1020.

In various implementations, content services device(s) 1030 may be hosted by any national, international and/or independent service and thus accessible to platform 1002 via the Internet, for example. Content services device(s) 1030 may be coupled to platform 1002 and/or to display 1020. Platform 1002 and/or content services device(s) 1030 may be coupled to a network 1060 to communicate (e.g., send and/or receive) media information to and from network 1060. Content delivery device(s) 1040 also may be coupled to platform 1002 and/or to display 1020.

In various implementations, content services device(s) 1030 may include a cable television box, personal computer, network, telephone, Internet enabled devices or appliance capable of delivering digital information and/or content, and any other similar device capable of uni-directionally or bi-directionally communicating content between content providers and platform 1002 and/display 1020, via network 1060 or directly. It will be appreciated that the content may be communicated uni-directionally and/or bi-directionally to and from any one of the components in system 1000 and a content provider via network 1060. Examples of content may include any media information including, for example, video, music, medical and gaming information, and so forth.

Content services device(s) 1030 may receive content such as cable television programming including media information, digital information, and/or other content. Examples of content providers may include any cable or satellite television or radio or Internet content providers. The provided examples are not meant to limit implementations in accordance with the present disclosure in any way.

In various implementations, platform 1002 may receive control signals from navigation controller 1050 having one or more navigation features. The navigation features of controller 1050 may be used to interact with user interface 1022, for example. In various embodiments, navigation controller 1050 may be a pointing device that may be a computer hardware component (specifically, a human interface device) that allows a user to input spatial (e.g., continuous and multi-dimensional) data into a computer. Many systems such as graphical user interfaces (GUI), and televisions and monitors allow the user to control and provide data to the computer or television using physical gestures.

Movements of the navigation features of controller 1050 may be replicated on a display (e.g., display 1020) by movements of a pointer, cursor, focus ring, or other visual indicators displayed on the display. For example, under the control of software applications 1016, the navigation features located on navigation controller 1050 may be mapped to virtual navigation features displayed on user interface 1022, for example. In various embodiments, controller 1050 may not be a separate component but may be integrated into platform 1002 and/or display 1020. The present disclosure, however, is not limited to the elements or in the context shown or described herein.

In various implementations, drivers (not shown) may include technology to enable users to instantly turn on and off platform 1002 like a television with the touch of a button after initial boot-up, when enabled, for example. Program logic may allow platform 1002 to stream content to media adaptors or other content services device(s) 1030 or content delivery device(s) 1040 even when the platform is turned "off" In addition, chipset 1005 may include hardware and/or software support for 5.1 surround sound audio and/or high definition 7.1 surround sound audio, for example. Drivers may include a graphics driver for integrated graphics platforms. In various embodiments, the graphics driver may comprise a peripheral component interconnect (PCI) Express graphics card.

In various implementations, any one or more of the components shown in system 1000 may be integrated. For example, platform 1002 and content services device(s) 1030 may be integrated, or platform 1002 and content delivery device(s) 1040 may be integrated, or platform 1002, content services device(s) 1030, and content delivery device(s) 1040 may be integrated, for example. In various embodiments, platform 1002 and display 1020 may be an integrated unit. Display 1020 and content service device(s) 1030 may be integrated, or display 1020 and content delivery device(s) 1040 may be integrated, for example. These examples are not meant to limit the present disclosure.

In various embodiments, system 1000 may be implemented as a wireless system, a wired system, or a combination of both. When implemented as a wireless system, system 1000 may include components and interfaces suitable for communicating over a wireless shared media, such as one or more antennas, transmitters, receivers, transceivers, amplifiers, filters, control logic, and so forth. An example of wireless shared media may include portions of a wireless spectrum, such as the RF spectrum and so forth. When implemented as a wired system, system 1000 may include components and interfaces suitable for communicating over wired communications media, such as input/output (I/O) adapters, physical connectors to connect the I/O adapter with a corresponding wired communications medium, a network interface card (NIC), disc controller, video controller, audio controller, and the like. Examples of wired communications media may include a wire, cable, metal leads, printed circuit board (PCB), backplane, switch fabric, semiconductor material, twisted-pair wire, co-axial cable, fiber optics, and so forth.

Platform 1002 may establish one or more logical or physical channels to communicate information. The information may include media information and control information. Media information may refer to any data representing content meant for a user. Examples of content may include, for example, data from a voice conversation, videoconference, streaming video, electronic mail ("email") message, voice mail message, alphanumeric symbols, graphics, image, video, text and so forth. Data from a voice conversation may be, for example, speech information, silence periods, background noise, comfort noise, tones and so forth. Control information may refer to any data representing commands, instructions or control words meant for an automated system. For example, control information may be used to route media information through a system, or instruct a node to process the media information in a predetermined manner. The embodiments, however, are not limited to the elements or in the context shown or described in FIG. 10.

Figure 11:
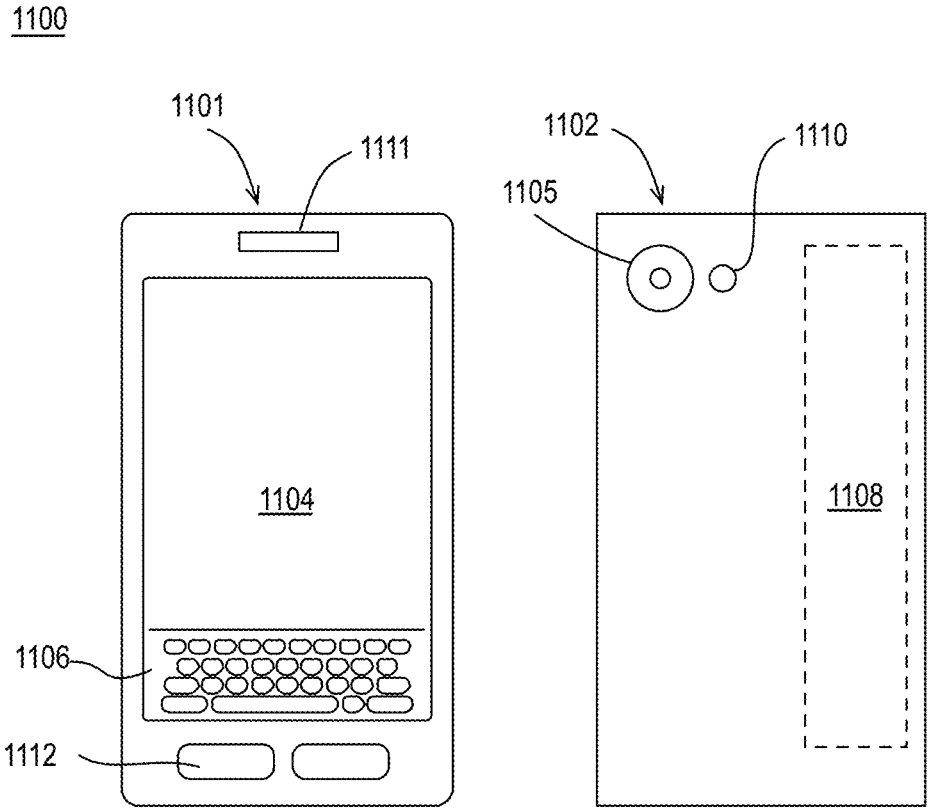
FIG. 11 illustrates an example small form factor device, all arranged in accordance with at least some implementations of the present disclosure.

As described above, system 1000 may be embodied in varying physical styles or form factors. FIG. 11 illustrates an example small form factor device 1100, arranged in accordance with at least some implementations of the present disclosure. In some examples, system 1000 may be implemented via device 1100. In other examples, other systems discussed herein such as system 900 or portions thereof or devices such as loudspeakers 100, 300 or portions thereof may be implemented via device 1100. In various embodiments, for example, device 1100 may be implemented as a mobile computing device a having wireless capabilities. A mobile computing device may refer to any device having a processing system and a mobile power source or supply, such as one or more batteries, for example.

Examples of a mobile computing device may include a personal computer (PC), laptop computer, ultra-laptop computer, tablet, touch pad, portable computer, handheld computer, palmtop computer, personal digital assistant (PDA), cellular telephone, combination cellular telephone/PDA, smart device (e.g., smartphone, smart tablet or smart mobile television), mobile internet device (MID), messaging device, data communication device, cameras (e.g. point-and-shoot cameras, super-zoom cameras, digital single-lens reflex (DSLR) cameras), and so forth.

Examples of a mobile computing device also may include computers that are arranged to be worn by a person, such as a wrist computers, finger computers, ring computers, eyeglass computers, belt-clip computers, arm-band computers, shoe computers, clothing computers, and other wearable computers. In various embodiments, for example, a mobile computing device may be implemented as a smartphone capable of executing computer applications, as well as voice communications and/or data communications. Although some embodiments may be described with a mobile computing device implemented as a smartphone by way of example, it may be appreciated that other embodiments may be implemented using other wireless mobile computing devices as well. The embodiments are not limited in this context.

As shown in FIG. 11, device 1100 may include a housing with a front 1101 and a back 1102. Device 1100 includes a display 1104, an input/output (I/O) device 1106, a camera 1105, a flash 1110, an integrated speaker, and an integrated antenna 1108. Device 1100 also may include navigation features 1112. I/O device 1106 may include any suitable I/O device for entering information into a mobile computing device. Examples for I/O device 1106 may include an alphanumeric keyboard, a numeric keypad, a touch pad, input keys, buttons, switches, microphones, speakers, voice recognition device and software, and so forth. Information also may be entered into device 1100 by way of microphone (not shown), or may be digitized by a voice recognition device. As shown, device 1100 may include camera 1105 and flash 1110 integrated into back 1102 (or elsewhere) of device 1100. In other examples, camera 1105 and flash 1110 may be integrated into front 1101 of device 1100 or both front and back cameras may be provided. Also as shown, device 1100 may include speaker 1111, which may include loudspeaker 100, 300, portions thereof, or any other components or systems as discussed herein. In an embodiment, speaker 1111 may include an audio modulator or a processor to implement an audio modulator and one or more MEMS valves disposed on a die to form a monolithic device such that the monolithic device is housed within speaker 1111.

Various embodiments may be implemented using hardware elements, software elements, or a combination of both. Examples of hardware elements may include processors, microprocessors, circuits, circuit elements (e.g., transistors, resistors, capacitors, inductors, and so forth), integrated circuits, application specific integrated circuits (ASIC), programmable logic devices (PLD), digital signal processors (DSP), field programmable gate array (FPGA), logic gates, registers, semiconductor device, chips, microchips, chip sets, and so forth. Examples of software may include software components, programs, applications, computer programs, application programs, system programs, machine programs, operating system software, middleware, firmware, software modules, routines, subroutines, functions, methods, procedures, software interfaces, application program interfaces (API), instruction sets, computing code, computer code, code segments, computer code segments, words, values, symbols, or any combination thereof. Determining whether an embodiment is implemented using hardware elements and/or software elements may vary in accordance with any number of factors, such as desired computational rate, power levels, heat tolerances, processing cycle budget, input data rates, output data rates, memory resources, data bus speeds and other design or performance constraints.

One or more aspects of at least one embodiment may be implemented by representative instructions stored on a machine-readable medium which represents various logic within the processor, which when read by a machine causes the machine to fabricate logic to perform the techniques described herein. Such representations, known as IP cores may be stored on a tangible, machine readable medium and supplied to various customers or manufacturing facilities to load into the fabrication machines that actually make the logic or processor.

While certain features set forth herein have been described with reference to various implementations, this description is not intended to be construed in a limiting sense. Hence, various modifications of the implementations described herein, as well as other implementations, which are apparent to persons skilled in the art to which the present disclosure pertains are deemed to lie within the spirit and scope of the present disclosure.

The following examples pertain to further embodiments.

In one or first embodiments, a digital loudspeaker comprises an air pressure source, at least one valve coupled to the air pressure source, and an audio modulator coupled to the valve, the audio modulator to receive an audio signal and to control the at least one valve via a modulation signal to provide an acoustic output from the digital loudspeaker.

Further to the first embodiments, the valve comprises a MEMS valve.

Further to the first embodiments, the air pressure source comprises at least one of a piezoelectric MEMS pump, an electrostatic MEMS pump, or a magnetic MEMS pump.

Further to the first embodiments, the valve comprises a MEMS valve and/or the air pressure source comprises at least one of a piezoelectric MEMS pump, an electrostatic MEMS pump, or a magnetic MEMS pump.

Further to the first embodiments, the at least one valve comprises a plurality of valves and the air pressure source comprises an air pump in fluid communication with a pressure chamber that is in fluid communication with inlets of the plurality of valves.

Further to the first embodiments, the digital loudspeaker further comprises a front cavity in fluid communication with an outlet of the valve.

Further to the first embodiments, the modulation signal comprises at least one of a pulse width modulation signal, a pulse density modulation signal, pulse amplitude modulation signal, or a pulse frequency modulation signal.

Further to the first embodiments, the at least one valve comprises a plurality of valves and the audio modulator is to generate a separate modulation signal for each of the plurality of valves.

Further to the first embodiments, the at least one valve comprises a plurality of valves and the modulation signal is to control all of the plurality of valves.

Further to the first embodiments, the at least one valve comprises a plurality of valves including at least a first group of valves and a second group of valves, the modulation signal is to control all of the plurality of valves in the first group and the audio modulator is to generate a second modulation signal to control all of the plurality of valves in the second group.

Further to the first embodiments, the digital loudspeaker further comprises a negative air pressure source, wherein the air pressure source comprises a positive air pressure source and at least one second valve coupled to the negative air pressure source.

Further to the first embodiments, the digital loudspeaker further comprises a negative air pressure source, wherein the air pressure source comprises a positive air pressure source and at least one second valve coupled to the negative air pressure source, wherein the at least one valve comprises a plurality of MEMS valves, the at least one second MEMS valve comprises a plurality of second MEMS valves, the air pressure source comprises an air pump in fluid communication with a positive pressure chamber that is in fluid communication with the plurality of MEMS valves, and the negative air pressure source comprises a second air pump in fluid communication with a negative pressure chamber that is in fluid communication with the plurality of second MEMS valves.

Further to the first embodiments, the digital loudspeaker further comprises a negative air pressure source, wherein the air pressure source comprises a positive air pressure source and at least one second valve coupled to the negative air pressure source, wherein the at least one valve comprises a plurality of MEMS valves, the at least one second valve comprises a plurality of second MEMS valves, the air pressure source comprises an air pump in fluid communication with a positive pressure chamber, the negative air pressure source comprises the air pump in fluid communication with a negative pressure chamber, the positive pressure chamber is in fluid communication with the plurality of MEMS valves, and the negative pressure chamber is in fluid communication with the plurality of second MEMS valves.

Further to the first embodiments, the at least one valve comprises a plurality of MEMS valves including a first MEMS valve having first characteristics and a second MEMS valve having at least one characteristic different than the first characteristics.

Further to the first embodiments, the audio modulator is to directly digitally generate the modulation signal based on the audio signal.

In one or second embodiments, a system comprises a memory configured to store audio data, an air pressure source, at least one valve coupled to the air pressure source, and a processor coupled to the valve and the memory, the processor to generate a modulation signal based on the audio data and to control the valve based on the modulation signal to provide an acoustic output from the digital loudspeaker.

Further to the second embodiments, the valve comprises a MEMS valve.

Further to the second embodiments, the air pressure source comprises at least one of a piezoelectric MEMS pump, an electrostatic MEMS pump, or a magnetic MEMS pump.

Further to the second embodiments, the at least one valve comprises a plurality of valves and the air pressure source comprises an air pump in fluid communication with a pressure chamber that is in fluid communication with inlets of the plurality of valves.

Further to the second embodiments, the at least one valve comprises a plurality of MEMS valves and the air pressure source comprises an air pump in fluid communication with a pressure chamber that is in fluid communication with inlets of the plurality of MEMS valves.

Further to the second embodiments, the modulation signal comprises at least one of a pulse width modulation signal, a pulse density modulation signal, pulse amplitude modulation signal, or a pulse frequency modulation signal.

Further to the second embodiments, the at least one valve comprises a plurality of valves and the processor is to generate a separate modulation signal for each of the plurality of valves.

Further to the second embodiments, the at least one valve comprises a plurality of valves and the modulation signal is to control all of the plurality of valves.

Further to the second embodiments, the at least one valve comprises a plurality of valves including at least a first group of valves and a second group of valves, the modulation signal is to control all of the plurality of valves in the first group and the audio modulator is to generate a second modulation signal to control all of the plurality of valves in the second group.

Further to the second embodiments, the system further comprises a negative air pressure source, wherein the air pressure source comprises a positive air pressure source and at least one second valve coupled to the negative air pressure source, wherein the air pressure source comprises an air pump in fluid communication with a positive pressure chamber that is in fluid communication with the at least one valve and the negative air pressure source comprises a second air pump in fluid communication with a negative pressure chamber that is in fluid communication with the at least one second valve.

Further to the second embodiments, a negative air pressure source, wherein the air pressure source comprises a positive air pressure source and at least one second valve coupled to the negative air pressure source, wherein the air pressure source comprises an air pump in fluid communication with a positive pressure chamber, and the negative air pressure source comprises the air pump in fluid communication with a negative pressure chamber.

Further to the second embodiments, the processor and the at least one valve are disposed on a single die to form a monolithic device.

Further to the second embodiments, the processor and the at least one valve are disposed on a single die to form a monolithic device and the monolithic device is housed within a speaker and the system comprises at least one of a laptop computer, a tablet, a smart phone, or a wearable device.

In one or third embodiments, a method for providing an acoustic output from a digital loudspeaker comprises receiving an audio signal, generating a modulation signal based on the received audio signal, and controlling at least one valve that is coupled to an air pressure source based on the modulation signal to provide an acoustic output.

Further to the third embodiments, the valve comprises a MEMS valve.

Further to the third embodiments, the air pressure source comprises at least one of a piezoelectric MEMS pump, an electrostatic MEMS pump, or a magnetic MEMS pump.

Further to the third embodiments, the valve comprises a MEMS valve and/or the air pressure source comprises at least one of a piezoelectric MEMS pump, an electrostatic MEMS pump, or a magnetic MEMS pump.

Further to the third embodiments, the modulation signal comprises at least one of a pulse width modulation signal, a pulse density modulation signal, pulse amplitude modulation signal, or a pulse frequency modulation signal.

Further to the third embodiments, the at least one valve comprises a plurality of valves and the modulation signal comprises a separate modulation signal for each of the plurality of valves.

Further to the third embodiments, the modulation signal comprises at least one of a pulse width modulation signal, a pulse density modulation signal, pulse amplitude modulation signal, or a pulse frequency modulation signal, and/or wherein the at least one valve comprises a plurality of valves and the modulation signal comprises a separate modulation signal for each of the plurality of valves.

Further to the third embodiments, the at least one valve comprises a plurality of valves and the modulation signal is to control all of the plurality of valves.

Further to the third embodiments, the at least one valve comprises a plurality of valves including at least a first group of valves and a second group of valves, the modulation signal is to control each of the plurality of valves in the first group and the method further comprises generating a second modulation signal to control each of the plurality of valves in the second group.

Further to the third embodiments, the method further comprises controlling at least one second valve that is coupled to a negative air pressure source based on the modulation signal.

Further to the third embodiments, the method further comprises controlling at least one second valve that is coupled to a negative air pressure source based on the modulation signal, wherein the at least one valve comprises a plurality of MEMS valves, the at least one second MEMS valve comprises a plurality of second MEMS valves, the air pressure source comprises an air pump in fluid communication with a positive pressure chamber that is in fluid communication with the plurality of MEMS valves, and the negative air pressure source comprises a second air pump in fluid communication with a negative pressure chamber that is in fluid communication with the plurality of second MEMS valves.

Further to the third embodiments, the method further comprises controlling at least one second valve that is coupled to a negative air pressure source based on the modulation signal, wherein the at least one valve comprises a plurality of MEMS valves, the at least one second valve comprises a plurality of second MEMS valves, the air pressure source comprises an air pump in fluid communication with a positive pressure chamber, the negative air pressure source comprises the air pump in fluid communication with a negative pressure chamber, the positive pressure chamber is in fluid communication with the plurality of MEMS valves, and the negative pressure chamber is in fluid communication with the plurality of second MEMS valves.

In one or fourth embodiments, a system comprises means for providing air pressure, at least one valve coupled to the means for providing air pressure, and means for generating a modulation signal based on a received audio signal to control the at least one valve to provide an acoustic output from the digital loudspeaker.

Further to the fourth embodiments, the valve comprises a MEMS valve.

Further to the fourth embodiments, the at least one valve comprises a plurality of valves and the means for providing air pressure comprises an air pump in fluid communication with a pressure chamber that is in fluid communication with inlets of the plurality of valves.

Further to the fourth embodiments, the system further comprises a front cavity in fluid communication with an outlet of the valve.

Further to the fourth embodiments, the modulation signal comprises at least one of a pulse width modulation signal, a pulse density modulation signal, pulse amplitude modulation signal, or a pulse frequency modulation signal.

Further to the fourth embodiments, the at least one valve comprises a plurality of valves and the means for generating the modulation signal comprise means for generating a separate modulation signal for each of the plurality of valves.

Further to the fourth embodiments, the at least one valve comprises a plurality of valves including at least a first group of valves and a second group of valves, the modulation signal is to control all of the plurality of valves in the first group and the means for generating the modulation signal comprise means for generating a second modulation signal to control all of the plurality of valves in the second group.

Further to the fourth embodiments, the system further comprises means for providing negative air pressure, wherein the means for providing air pressure provides a positive air pressure and at least one second valve coupled to the means for providing negative air pressure.

Further to the fourth embodiments, the at least one valve comprises a plurality of MEMS valves including a first MEMS valve having first characteristics and a second MEMS valve having at least one characteristic different than the first characteristics.

Further to the fourth embodiments, the means for generating the modulation signal comprise means to directly digitally generate the modulation signal based on the audio signal.

In one or more fifth embodiments, at least one machine readable medium may include a plurality of instructions that in response to being executed on a computing device, causes the computing device to perform a method according to any one of the above embodiments.

In one or more sixth embodiments, an apparatus may include means for performing a method according to any one of the above embodiments.

It will be recognized that the embodiments are not limited to the embodiments so described, but can be practiced with modification and alteration without departing from the scope of the appended claims. For example, the above embodiments may include specific combination of features. However, the above embodiments are not limited in this regard and, in various implementations, the above embodiments may include the undertaking only a subset of such features, undertaking a different order of such features, undertaking a different combination of such features, and/or undertaking additional features than those features explicitly listed. The scope of the embodiments should, therefore, be determined with reference to the appended claims, along with the full scope of equivalents to which such claims are entitled.

What is claimed is:

1. A digital loudspeaker comprising:

an air pump coupled between a high-pressure chamber and a low-pressure chamber;

a plurality of first valves, individual ones of the first valves having an inlet in fluid communication with the high-pressure chamber and an outlet in fluid communication with a front cavity;

a plurality of second valves, individual ones of the second valves having an inlet in fluid communication with the front cavity an outlet in fluid communication with the low-pressure chamber; and an audio modulator coupled to the first and second valves, the audio modulator to receive an audio signal and to control the valves via a modulation signal to provide an acoustic output from the front cavity.

2. The digital loudspeaker of claim 1, wherein individual ones of the first and second valves comprise a MEMS valve.

3. The digital loudspeaker of claim 1, wherein the air pressure pump comprises at least one of a piezoelectric MEMS pump, an electrostatic MEMS pump, or a magnetic MEMS pump.

4. The digital loudspeaker of claim 1 wherein the front cavity is exposed to ambient atmosphere, the low pressure chamber is below ambient atmospheric pressure, and the high pressure chamber is above ambient atmospheric pressure.

5. The digital loudspeaker of claim 1, wherein the modulation signal comprises at least one of a pulse width modulation signal, a pulse density modulation signal, pulse amplitude modulation signal, or a pulse frequency modulation signal.

6. The digital loudspeaker of claim 1, wherein the audio modulator is to generate a separate modulation signal for individual ones of the first or second valves.

7. The digital loudspeaker of claim 1, wherein the modulation signal is to control all of the first valves.

8. The digital loudspeaker of claim 1, wherein the modulation signal is to control all of the plurality of first valves and the audio modulator is to generate a second modulation signal to control all of the plurality of second valves.

9. The digital loudspeaker of claim 1, wherein the plurality of first or second valves comprises a plurality of MEMS valves including a first MEMS valve having first characteristics and a second MEMS valve having at least one characteristic different than the first characteristics.

10. The system of claim 9, wherein the front cavity comprises a Hemholtz resonator.

11. The digital loudspeaker of claim 1, wherein the audio modulator is to directly digitally generate the modulation signal based on the audio signal.

12. The digital loudspeaker of claim 1, wherein the front cavity comprises a Hemholtz resonator.

13. The digital loudspeaker of claim 1, wherein:

the first and second plurality of valves are arrayed over a surface of the front cavity;

the first plurality of valves are arrayed over a surface of the high-pressure chamber; and the second plurality of valves are arrayed over a surface of the low-pressure chamber.

14. A system comprising:

a memory configured to store audio data;

an air pump coupled between a high-pressure chamber and a low-pressure chamber;

a plurality of first valves, individual ones of the first valves having an inlet in fluid communication with the high pressure chamber and an outlet in fluid communication with a front cavity;

a plurality of second valves, individual ones of the second valves having an inlet in fluid communication with the front cavity an outlet in fluid communication with the low-pressure chamber; and a processor coupled to the first and second valves and the memory, the processor to generate a modulation signal based on the audio data and to control the first and second valves based on the modulation signal to provide an acoustic output from the front cavity.

15. The system of claim 14, wherein the plurality of first and second valves comprise a plurality of MEMS valves.

16. The system of claim 14, wherein the processor is to generate a separate modulation signal for individual ones of the first or second valves.

17. The system of claim 14, wherein the processor and the first and second valves are disposed on a single die to form a monolithic device.

18. The system of claim 17, further comprising a wireless radio coupled to the processor; and wherein the monolithic device is housed within a wireless ear bud.

19. At least one non-transitory machine readable medium having a plurality of instructions stored thereon that, in response to being executed by a device, cause the device to provide an acoustic output by:

receiving an audio signal;

generating a modulation signal based on the received audio signal; and controlling a plurality of first valves and a plurality of second valves coupled to an air pump based on the modulation signal to provide an acoustic output, wherein individual ones of the first valves have an inlet in fluid communication with a high-pressure side of the pump and an outlet in fluid communication with a front cavity, and individual ones of the second valves have an inlet in fluid communication with the front cavity an outlet in fluid communication with a low-pressure side of the pump.

20. The machine readable medium of claim 19, wherein the modulation signal comprises at least one of a pulse width modulation signal, a pulse density modulation signal, pulse amplitude modulation signal, or a pulse frequency modulation signal.

21. The machine readable medium of claim 19, wherein the modulation signal comprises a separate modulation signal for individual ones of the first or second valves.

22. The machine readable medium of claim 19, wherein the first and second valves comprise a plurality of MEMS valves, the modulation signal is to control all of the first valves and the machine readable medium comprises further instructions that, in response to being executed by the device, cause the device to provide the acoustic output by generating a second modulation signal to control all of the second valves.

23. The medium of claim 19, wherein the front cavity comprises a Hemholtz resonator.

* * * * *